United States Patent [19]

Meckler

[11] Patent Number: 4,691,530

[45] Date of Patent: Sep. 8, 1987

[54] COGENERATION AND CENTRAL REGENERATION MULTI-CONTACTOR AIR CONDITIONING SYSTEM

[76] Inventor: Milton Meckler, 16348 Tupper St., Sepulveda, Calif. 92343

[21] Appl. No.: 903,690

[22] Filed: Sep. 5, 1986

[51] Int. Cl.[4] ..... F25D 23/00

[52] U.S. Cl. ..... 62/238.1; 62/271; 62/323.1; 55/228; 55/229

[58] Field of Search ..... 62/93, 92, 238.1, 238.6, 62/323.1, 323.2, 271; 55/228, 229

[56] References Cited

U.S. PATENT DOCUMENTS 2,262,954 11/1941 Mattern et al. ..... 62/94 X
2,284,914 6/1942 Miller ..... 62/238.1 X
4,011,731 3/1977 Meckler ..... 62/271 X
4,033,740 7/1977 Meckler ..... 62/331 X
4,164,125 8/1979 Griffiths ..... 62/271 X

*Primary Examiner*—William E. Tapolcai
*Attorney, Agent, or Firm*—William H. Maxwell

[57] ABSTRACT

Cogenerating air conditioning comprised of a support system having a continuously operating desiccant regenerator with desiccant storage and employing waste heat from a prime mover driving a co-generator, and an air handling system having multiple desiccant contactors supplied from stored desiccant to dehumidify building return air and having heating coils employing waste heat from said prime mover and with cooling coils employing regeneration chilled water and/or evaporatively chilled water, with chilled water being employed to continuously purge fire sprinkler mains.

22 Claims, 5 Drawing Figures

Y
S
MIXED
DESICCANT STORAGE
CONCENTRATED/DILUTE
REGENERATOR
R
INDIRECT
EVAP.
CHILLER
40
WATER
HEATER
W
HEAT
EXCHANGER
42
PRIME MOVER
P
GEN.
G
EXH
OSA
HWS
HWR
1
2
5
6
7
8
15
16
22
23
28
29
30
31
32
33
34
35
36
37
38
39
41
43
44
44'
45
46

X
CONCENTRATE
HWR
HWS
CHWS
CHWR
SA
RA
COOLING COIL
HEATING COIL
CONTACTOR
INDIRECT EVAP. COOLER
EXH
OSA
DILUTE
A
C
E

COGENERATION AND CENTRAL REGENERATION MULTI-CONTACTOR AIR CONDITIONING SYSTEM

BACKGROUND OF THE INVENTION

This invention relates to cogeneration associated air conditioning wherein the working fluid is a hygroscopic (i.e. desiccant) solution and wherein the moisture concentration is processed by a desiccant regeneration unit serving a multiplicity of contactors (i.e. units) or dehumidifiers. Heretofore, the regenerator and contactor units have been balanced so that the capability of the former meets the demand of the latter. That is, the desiccant regenerator unit and contactor unit have been selected for compatability one with the other. Therefore, these complementary units have been selected for peak load conditions, and they have not been used to their ultimate effectiveness during moderate or low load conditions, nor has either unit been effectively used during no load conditions. It is therefore an object of this invention to advantageosuly employ a multiplicity of space air handling units in a system characterized by at least one central service system, and preferably a service system which features a single regenerator unit for regenerating the hydroscopic solution and which supplies a multiplicity of contactor units preconditioning outside or mixed outside and return air, and wherein each contactor unit can service one or more cooling coils for sensible heat absorbtion in space air distribution means.

Air conditioning systems of the type under consideration have employed the direct cooperation of desiccant regenerators and dehumidifying contactors supplied with concentrated desiccant therefrom. In fact, these two units are often combined as a single apparatus having a common sump, in which case the capacity of one matches the other. With the present invention, the capacity of the regenerator unit is deliberately selected to meet the contactor unit, or units, requirements for a total work output per period of time. That is, the regenerator capacity for a total 24 hour day of maximum requirement can be selected, whereby said regenerator unit is operated at full capacity on a continuing basis; except for shutdown when air conditioning is reduced or is terminated. Accordingly, it is an object of this invention to provide for storage of the working desiccant fluid processed by the continuously operating regenerator unit. With the present invention, a working fluid storage tank accumulates the desiccant fluid processed by the regenerator unit for subsequent use by the multiplicity of contactor units.

The central desiccant regenerator unit (preferably but one but in some instances more than one) requires heat application for its operation, and to this end the waste heat of combustion from a prime mover of the heat engine type is employed on a continuous basis for a defined operating period of time. Accordingly, it is an object of this invention to combine an electrical cogeneration unit with the air conditioning regeneration unit for its continuous operation during defined operating period, both at full or substantially, cost effective, full capacity.

By continuous operation, it is meant that the regenerator, being undersized so to speak is chosen for peak coincident moisture load for the multiplicity of contactor units in service, is required to operate at or near its rated capacity for extended periods of time, such that it is capable of removing the same pounds of moisture per operating day that a so called full sized regenerator might provide if operated in the normally accepted manner to meet the varying instantaneous moisture loads.

The storage tank which characterizes this invention can be a singular tank for averaging the strength of the desiccant, or it can be separated into a first stage receiver tank of weakened desiccant fluid, and a second stage supply tank of strong regenerated desiccant fluid. It is an object of this invention to separate the storage of the hydroscopic desiccant fluid so that the weakened returned desiccant fluid is not commingled with the strengthened desiccant that has been regenerated for use in the multiplicity of contactor units. With the present invention, there is a receiver tank that receives weakened desiccant discharged by the contactor units, and holds the same for supplying the regenerator on demand. And there is a supply tank that accumulates strengthened desiccant from the regenerator unit and holds the same for supplying the contactor units on demand.

The processed desiccant fluid stored in the working fluid storage tank or tanks is supplied to the multiplicity of contactors for conditioning of air supplied by evaporative chilling and preferably by a single indirect evaporative chiller within the central support system. A feature and an object of this invention is to advantageously employ the circulation of chilled water to and/or from cooling coil units, by directing the same through automatic fire sprinkler mains and thereby continuously purging the same on a full time basis.

Contactor unit operation requires chilling, and to this end it is an object of this invention to provide a single indirect chiller within the central support system. With this invention there is an indirect evaporative chiller that supplies the cooling coils of a multiplicity of contactor units.

From the foregoing it is apparent that a general object of this invention is to separate an air conditioning installation into a continuosuly operating support and total dehumidification system and a demand operated sensible cooling air handling system. The support system is characterized by a generator unit or units operating on a cost effective full time basis, or substantially so, and by storage of desiccant fluid processed thereby, and preferably supported by a congeneration electrical generator unit also operating on a cost effective full time basis. The air handling system is characterized by a multiplicity of contactor units operated on demand and supplied with processed desiccant fluid from the aforesaid storage as circumstances require. The air handling system includes a multiplicity of air handling units that have cooling coils associated with a refrigeration unit, an evaporation or mechanial chiller, and a cooling tower as shown and described. And the air handling units have heating coils associated with a water heater or boiler also drawing waste heat from the cogeneration prime mover.

SUMMARY OF THE INVENTION

This invention utilizes the available waste heat of combustion from cogenerated electrical power to operate a central regenerator unit that supplies a multiplicity of contactor units and each supplying preconditioned dehumidified air to a multiplicity of air handling units serving separate occupied space areas that are conditioned thereby. The central regenerator unit, or units, is continusouly operated at substantial or full capacity based upon moisture loading requirements of the combined space areas being conditioned. When the desiccant liquid level rises to a predetermined maximum level in any one contactor unit, desiccant is automatically diverted to the working fluid storage tank. A portion of the diluted desiccant liquid is continuously removed from the tank and supplied to the central regeneration unit while concentrated desiccant liquid is simultaneously returned to the storage tank from the central regeneration unit. Concentrated desiccant is automatically pumped to a multiplicity of contactor units from the storage tank as may be required, so as to maintain a satisfactory balance throughout the interconnected desiccant distribution system. As shown, each contactor unit supplies treated ventilation air to one or more separate air handling units. For example, there are two or more contactor units, each serving at least one or more air handling units. Each contactor unit is served from a mechanically chilled or an evaporatively chilled water source, the proportion of which is dependent upon the revailing interior space demands, and upon prevailing caioncident ambient conditions, etc.

In accordance with this invention, chilled water is circulated in a network of overhead fire sprinkler piping of conventionally designed distribution, serving as branch interconnections of either supply or return flow, or both, thereby promoting circulation through the sprinkler system on a continuing basis.

The central and common regenerator system is arranged to serve a number of individual contactor units, as follows: Each contactor unit removes moisture from the outside and space return air in order to maintain the occupied spaced within predetermined comfort limits, and dilute desiccant is circulated therefrom to the mixed concentrated or dilute working fluid storage tank, as shown. Desiccant from the storage tank is continuously recirculated to and from the central regenerator unit so that the average desiccant concentration in the storage tank is capable of meeting the design needs of any contactor unit which is also supplied with regenerated desiccant therefrom. Note that cooling tower water is used to cool the contents of the storage tank as needed, so as to maintain a vapor pressure of the desiccant solution in the tank within a proper range at all times, and for meeting design requirements of any controlling contactor unit. Thus, the regenerator unit of the support system meets the coincident peak design requirements of all interconnected contactor units of the air handling system or systems. The regenerator unit is self contained and utilizes waste prime mover heat for regenerating the desiccant solution in the working fluid storage.

A feature of this invention is that the size and capacity of the regenerator unit can be substantially less than the conventional peak design requirements, since by providing a smaller unit and by operating it at essentially full and constant load for the duration of a building's occupied hours, the same total "system" moisture removal capability is achieved as a larger regenerator or series of coupled contactor-regenerator units, following the actual hourly moisture load would provide by tracking the load directly. Consequently, by coupling the available heat rejection of a cogeneration prime mover (including water jacket heat), diesel or turbine or the like, matched to the smaller regenerator unit, the utilization of the cogeneration unit is increased, thereby assuring a constant cost effective supply of associated electrical power to the building facility being air conditioned.

The foregoing and various other objects and features of this invention will be apparent and fully understood from the following detailed description of the typical preferred forms and applications thereof, throughout which description reference is made to the accompanying drawings.

THE DRAWINGS

Figure 5:
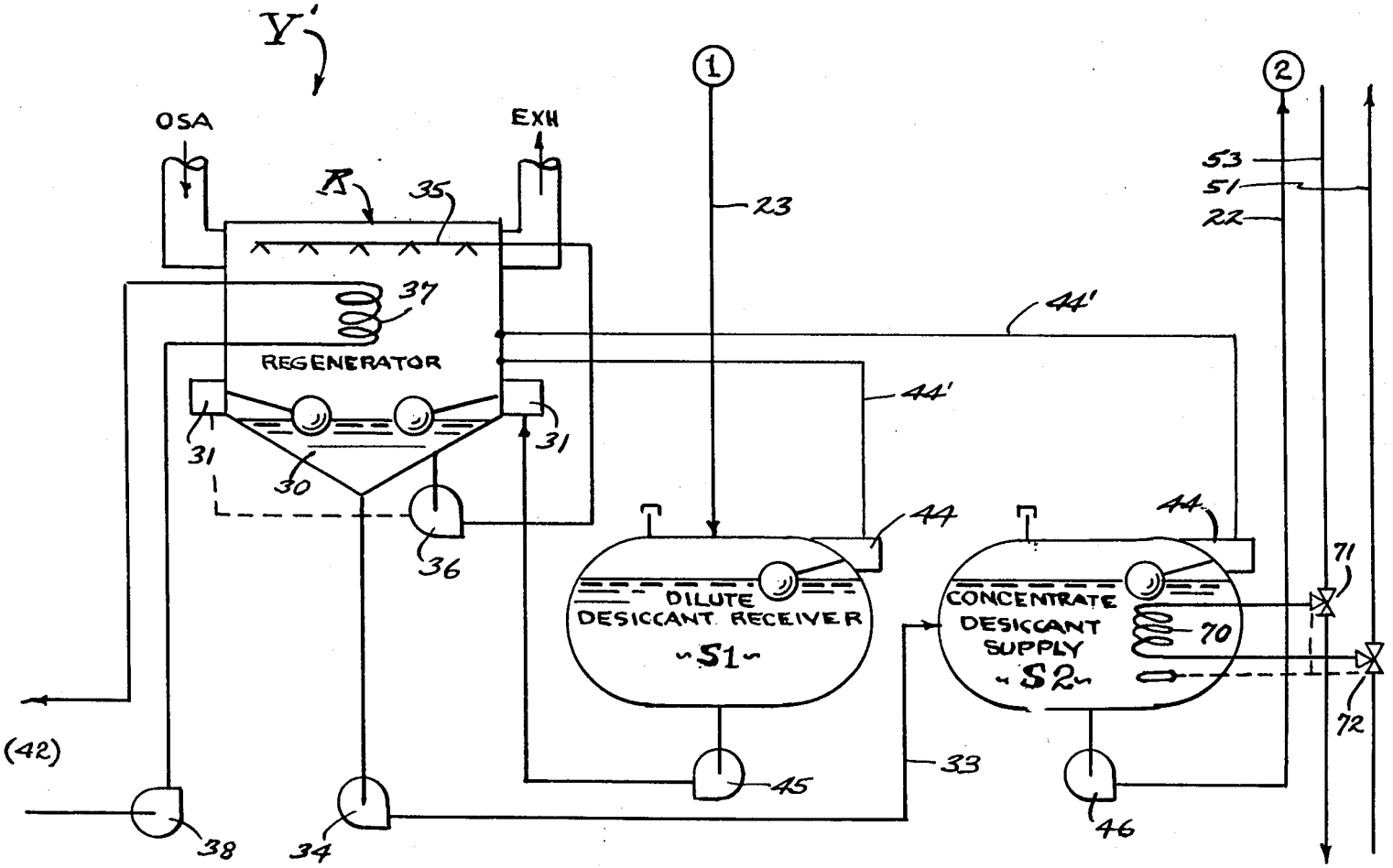

And, FIG. 5 is a modified form of the support system wherein the storage of desiccant fluid is separated between the weak return desiccant and the regenerated or concentrated ( strengthened) desiccant.

PREFERRED EMBODIMENT:

Referring now to the drawings, the cogeneration air conditioning installation of the present invention involves the separation of distinct systems thereof, so that both cogeneration of power and regeneration of desiccant liquid is carried out on a continuing basis for a substantial portion of a daily operating period. Accordingly, the air handling system is distinct and operates on a demand basis, while the desiccant regeneration system operates on a continuing basis. The general purpose of this distinctive advantage is to select a regeneration unit R of optimum capacity with the provision of a desiccant storage means S, to the end that a multiplicity of contactor units C can be operated as circumstances require. Cogeneration of electric power is by means of a prime mover P of the heat engine type with its waste heat employed to support the operation of the regenerator unit R and to support the operation of a boiler or hot water heater W. Chilled water is provided by means of a refrigeration unit or chiller B used with a cooling tower T. The cooling coils of the air handling units A are supplied with mechanically or evaporatively chilled water through a fire sprinkler system F, whereby that system is purged on a continuous basis. As shown, generally, there is a demand operated sensible air handling system X supplied with regenerated desiccant liquid from a continuously operating support system Y, and with hot and chilled water supplied from a demand operating support system Z.

Figure 1:
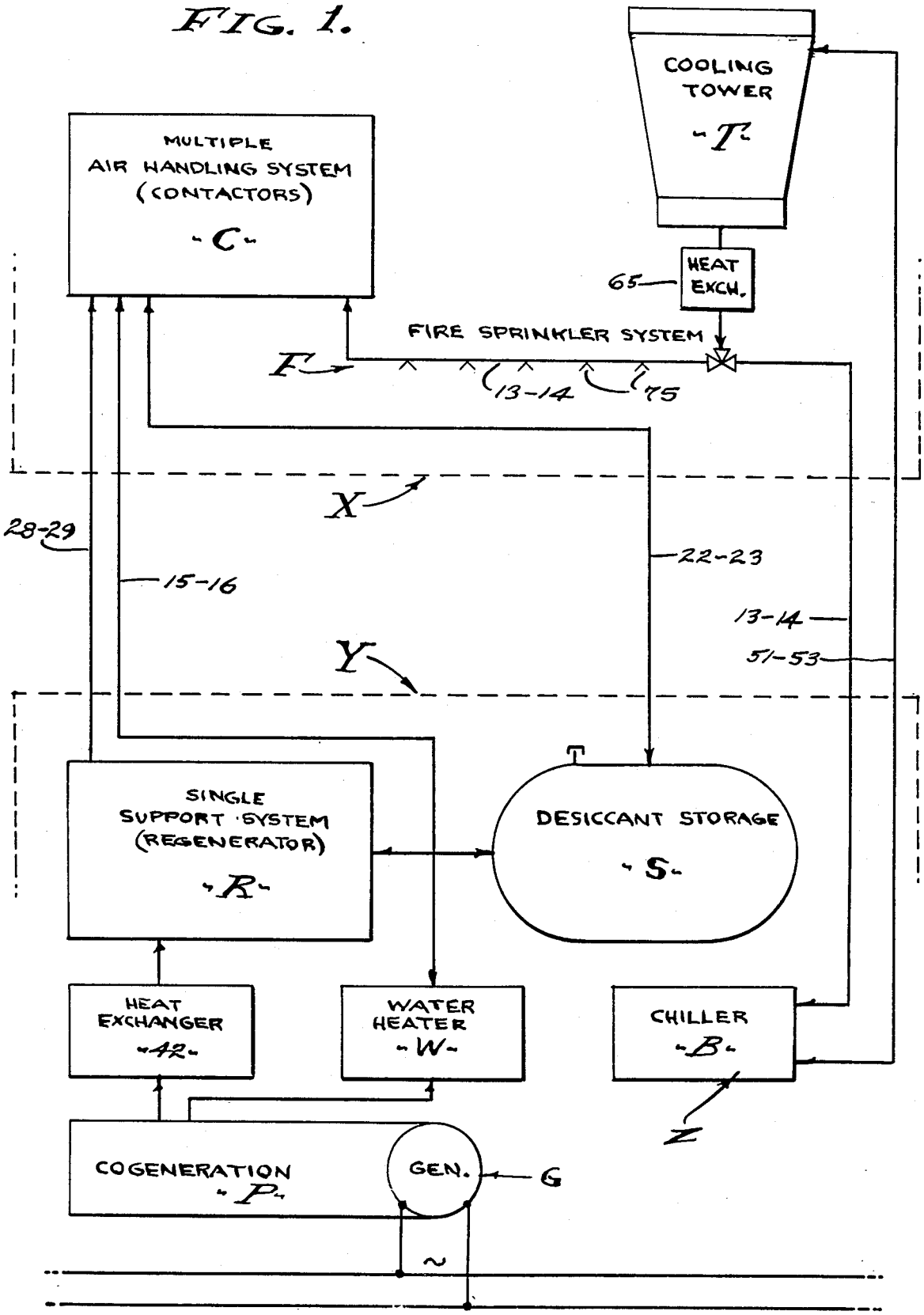
FIG. 1 is a block diagram of a cogeneration air conditioning installation including the demand operated air handling system supported by the continuously operating support system of the present invention.
Figure 4:
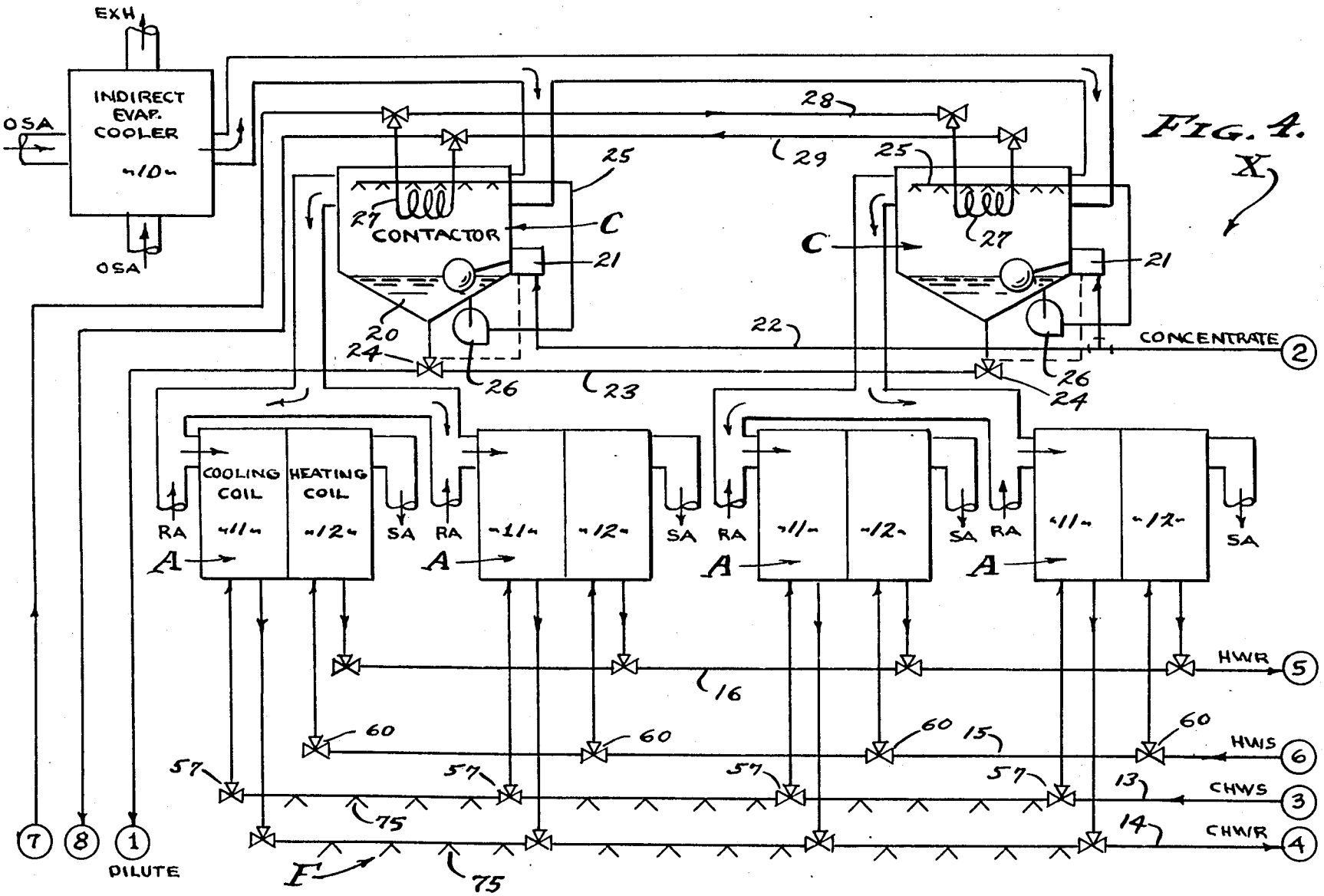
FIG. 4 is a schematic diagram of the demand operated air handling system portion shown in FIG. 1.

Referring to FIGS. 1 and 4 of the drawings, the air handling system X is a demand operated system comprised generally of at least two or a multiplicity of contactor units C and each supplying dehumidified air to at least one or more air handling units A. As shown, the contactor units C are supplied with sensibly cooled outside air (OSA) passed through an indirect evaporative cooler 10. Air circulation is by means of blowers (not shown) as indicated by the ducting and arrows of FIG. 4. The cooler separately passes outside air (OSA) for exhaust (EXH) into the atmosphere. The cooled air circulates through the contactor units C for dehumidification and discharge through the air conditioning units C providing the required sensible cooling of supply air (SA) and recirculated return air (RA) from the conditioned building area. As shown, there are two contactor units C, each supplying a pair of air handling units A. The air handling units A are alike, each including cooling and heating coils 11 and 12. The cooling coils are supplied by a chilled water supply (CHWS) through a header or main 13 designated by the numeral 3, and they discharge through a header or main 14 designated by the numeral 4 or a chilled water return (CHWR). The heating coils are supplied by a hot water supply (HWS) through a header or main 15 designated by the numeral 6, and they discharge through a header or main 16 designated by the numeral 5 or hot water return (HWR).

Referring specifically to the desiccant regeneration unit R, and to the dehumidifying contactor units C, these units employ a strong desiccant or hygroscopic solution that is pumped from a sump and sprayed over coils, a solution such as water and lithium or calcium chloride or ethylene glycol. Air to be dehumidified or humidified is passed over the coils in intimate contact with the hygroscopic solution, the degree of dehumidification or humidification being dependent upon the concentration, temperature and characteristics of said solution. Moisture is absorbed from the air by said solution maintained at the proper concentration due to the vapor pressure difference between the air and the solution and is precisely maintained by varying coolant flow applied to the coils so as to control the solution temperature. Heat is generated in absorbing moisture from the air, the latent heat from condensation of water vapor and heat of solution, or heat mixing of the water and the hygroscopic solution. The solution is maintained at the required temperature of cooling with chilled fluid. The quantity of chilling or cooling required is a function of the solution temperature and the total heat, either sensible, latent of both, removed from the air by the hygroscopic solution. The total heat removal required consists of the heat absorption, sensible heat removed from the air, and the residual heat load added by the regeneration process.

According to the above, the contactor units C are comprised of a sump 20 filled to a normal level with desiccant liquid and controlled by a float valve means 21 supplying regenerated desiccant liquid through a header or main 22 and designated by the numeral 2. Surplus desiccant build-up in the sump is discharged through a header or main 23 and designated by the numeral 1, by valve means 24 controlled by the float valve means 21. A spray means 25 disharges desiccant liquid into the contactor from a sump pump 26 and in the presence of chilling coils 27 supplied with chilled fluid through a header or main 28 designated by the numeral 7. Return of said chilled fluid is through a header or main 29 designated by the numeral 8. The contactor temperature is controlled by thermostat means (not shown) which controls the chilling effect at coils 27. As shown, air is circulated through the contactor units C for dehumidification.

Figure 3:
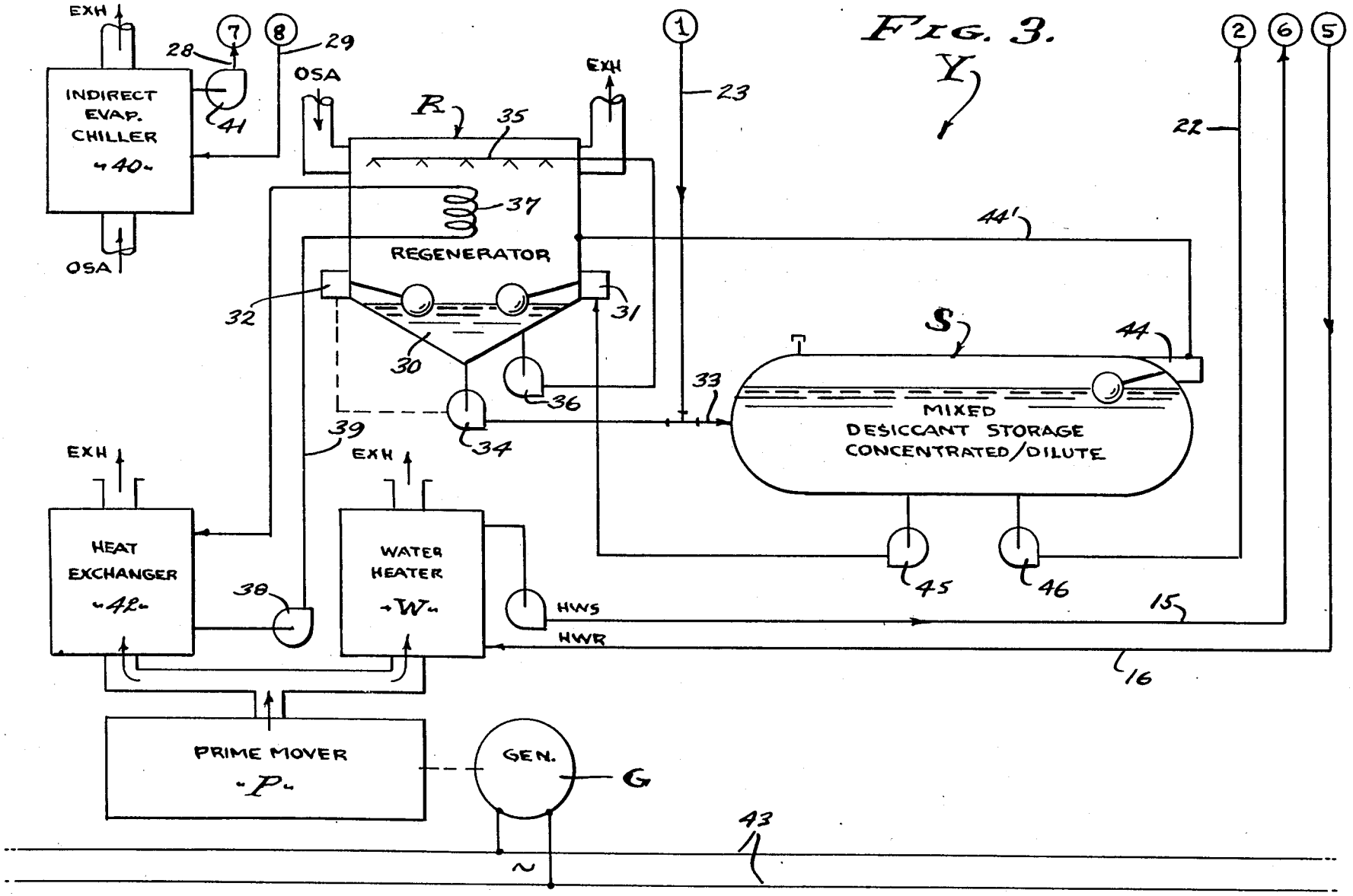
FIG. 3 is a schematic diagram of the continuously operating dehumidification portion of the support system shown in FIG. 1.

Referring to FIGS. 1 and 3 of the drawings, the support system Y is a continuously operating system comprised generally of at least and preferably one regenerator unit R, a humidifier, that delivers processed desiccant liquid to the storage means or tank S. As above stated, a primary objective of this invention is to select one or more regenerators having a predetermined operating capacity adapted to continuous operation when associated with the multiplicity of air handling contactor units which it supplies. A feature is therefore, the desiccant liquid storage tank S from which the regenerator R draws weak desiccant liquid for regeneration and return to said tank for storage therein. Accordingly, the storage tank S supplies the contactor units C with strong desiccant liquid from the tank through a main 22 and designated by the numeral 2, with return of weak desiccant liquid thereto through a main 23 and designated by the numeral 1.

According to the above, the regenerator unit R is comprised of a sump 30 filled to a normal level with desiccant liquid and controlled by a float valve means 31 supplying a weakened desiccant liquid from the storage tank S. Build-up of regenerated desiccant liquid in the sump is discharged through the main 33, by pump means 34 controlled by a float valve means 32. A spray means 35 discharges desiccant liquid into the regenerator from a sump pump 36 and in the presence of heating coils 37 supplied with heating fluid delivered by pump means 38 through a main 39. The regenerator temperature is controlled by thermostat means (not shown) which controls the heating effect of coils 37.

In accordance with this invention, the support means Y includes two separate sources of heat controlling fluid, firstly a source of chilling fluid circulated through the mains 28 and 29 for determining the operating temperature of the contactor units C, and secondly a source heating fluid circulated through the coils 37 for determining the operating temperature of regenerator R.

The first heat control source is by means of a chiller 40, preferably an indirect evaporative chiller using outside air (OSA) to outside exhaust (EXH) by means of a blower (not shown). The chiller 40 delivers chilled fluid through main 28 by means of a pump 41, and returns thereto through the main 29, whereby the contactor units C are supplied with a closed circuit fo heat controlling fluid.

The second heat control source is by means of a heat exchanger 42 using waste heat of combustion from the prime mover P, a heat engine. In practice, the prime mover P is a diesel engine, turbine or the like, wherein a substantial amount of waste heat is exhausted, said prime mover exhaust being directed as shown through the heat exchanger 42 to exhaust (EXH) to atmosphere at substantially lower temperature for an advantageous environmental effect. The prime mover P, like the regeneration unit R, is selected to have a capacity for operation on a continuous, cost effective basis, driving a generator G supplying a minimum daily power requirement to buss lines 43 supplying the building or facility involved for a specified extended time period at a level at or below coincident required building electrical demand.

The storage tank S is vented and the desiccant liquid level therein determined by a float valve means 44 that controls operation of the regenerator unit R through a line 44'. Desiccant liquid is delivered to the regenerator R by pump means 45, and is delivered to the contactor units C by pump means 46.

Figure 2:
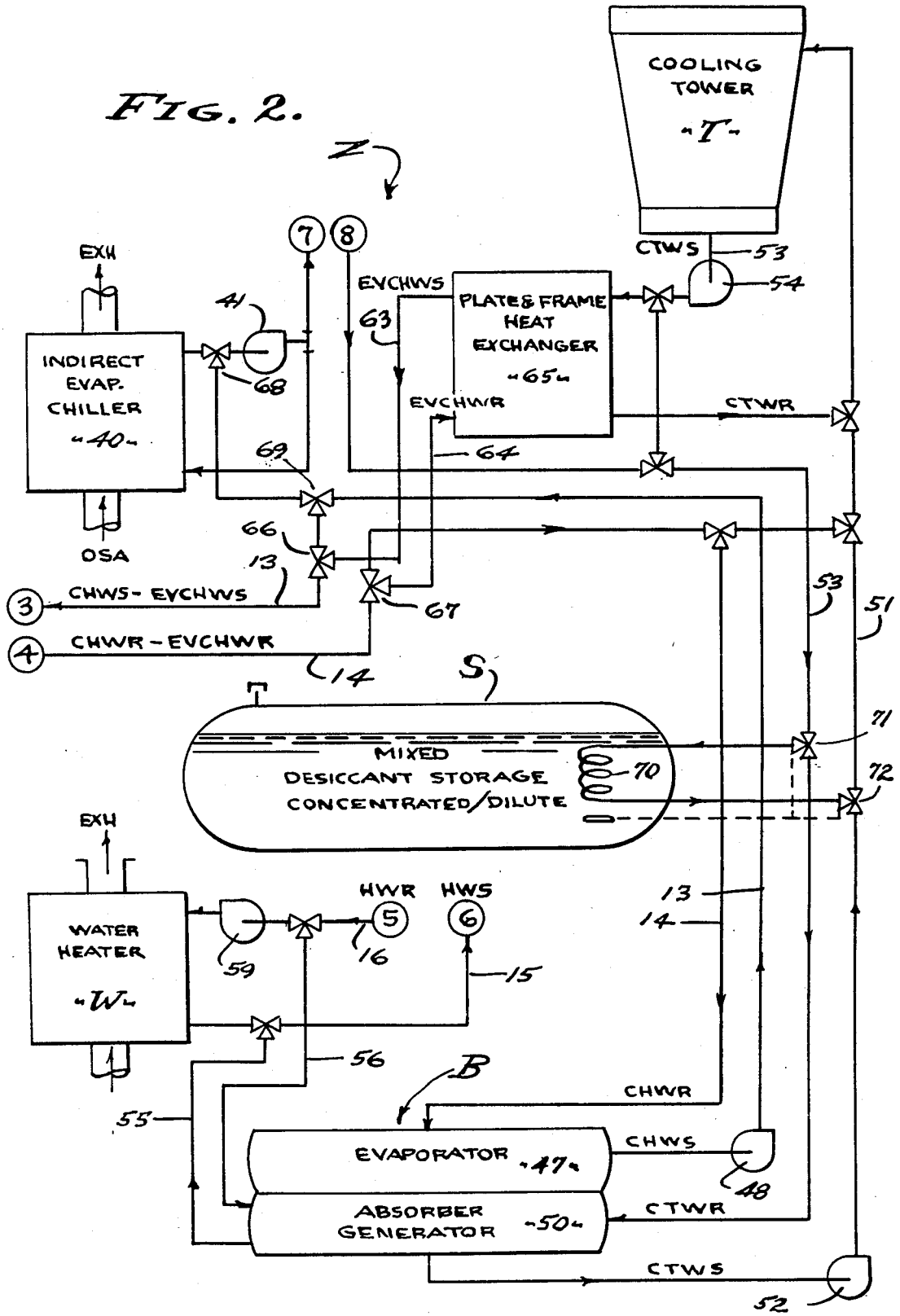
FIG. 2 is a schematic diagram of the hot water and chilled water portion of the support system shown in FIG. 1.

Referring to FIGS. 1 and 2 of the drawings, the support system Z is a demand operated system that includes two conditioning sources in the form of two sources of heat controlling fluid, a third heat control source of chilling fluid circulated through the headers or mains 13 and 14 as designated by the numerals 3 and 4, and a fourth heat control source of heating fluid circulated through the headers or mains 15 and 16 as deignated by the numerals 6 and 5. The third source is for supplying the cooling coils of the air conditioning units A, and the fourth source is for supplying the heating coils of the air conditioning units A.

The third heat control source is by means of a refrigeration unit such as the chiller B, which can be of any suitable type, mechanical or the absorption cycle type. As shown, the evaporator 47 feeds the chilled water supply (CHWS) main 13 through a pump means 48; chilled water return (CHWR) being through the main 14, a closed circuit through the cooling coils 11 of the air handling units A. The absorbergenerator 50 has a cooling tower water supply (CTWS) main 51 through a pump means 52 to the cooling tower T, and a return (CTWR) 53 through a pump means 54. Make-up water is supplied through valve controlled connections 55 and 56 from the mains 15 and 16 of the heat control means next described. Thermostat controlled valves 57 in mains 13 and/or 14 control the chilling coils 11 of the air handling units A, as is clearly indicated in FIG. 4.

The fourth heat control source is by means of the boiler or water heater W having a hot water supply (HWS) 15 employing waste heat from the prime mover P exhaust heat shared with the heat exchanger 42 serving the regenerator unit R. As shown, the prime mover exhaust is directed through water heater W to exhaust (EXH) to atmosphere the same as the heat exchanger 42. The water heater W feeds the hot water supply (HWS) through the main 15, and return is by pump means 59. Thermostat controlled valves 60 in the main 15 and/or 16 controls the heating coils 12 of the air handling units A, as is clearly indicated in FIG. 4.

An alternate or supplemental source of chilling fluid into the closed circuit of mains 13 and 14 is from the cooling tower T through a plate-frame heat exchanger 65. As shown, there is an evaporatively chilled water supply (EVCHWS) 63, and there is an evaporatively chilled water return (EVCHWR) 64 through the heat exchanger 65, with suitable thermostat control valves 66 and 67 tapping into said mains 13 and 14.

A make-up source of chilled water into the closed circuit of mains 28 and 28 of the chiller 40 is from main 13 and through pump 41 and controlled by suitable valves 68 and 69 tapping into said mains 13 and 14.

Cooling of stored desiccant liquid is by means of cooling coils 70 supplied with chilled fluid from the mains 51 and 53, throught thermostatically controlled valves 71 and 72.

In accordance with this invention, the chilled water supply mains 13 and/or 14 is advantageously used to continuously purge an automatic fire sprinkler system comprised of heat activated nozzles 75 incorporated into said mains, as clearly shown in FIGS. 1 and 4 of the drawings. The constant, though intermittent, flow of chilled liquid (not hot) through the mains 13 and/or 14 continuously purges said mains on a permanent basis so that they are maintained in an operative condition in the event that there is a fire. That is, the normal operation of the contactor units A ensures and provides a positive indication that the mains 13 and 14 are clear for effective operation of the heat activated nozzles in case of an emergency.

Referring now to FIG. 5 of the drawings, a modified portion of the support system Y' is shown, wherein there is a receiver tank $S_1$ and a supply tank $S_2$ associated with the regenerator unit R. The regenerator unit R remains the same as hereinabove described. However, the above described storage tank S is separated into two tanks, so that the weakened return desiccant fluid does not adversely affect the regenerated and strengthened desciccant fluid from the regenerator R. Accordingly, the discharge from the contactor units C through the header or main 23, also designated by the numeral 1, is into a receiver tank $S_1$, from which tank it is supplied on demand to the float valves means 31 of the regenerator R, by the pump means 45. The pump means 34 then delivers the regenerated desiccant fluid through the main 33 and into a supply tank $S_2$, from which tank the desiccant in supplied on demand to the float valve means 21 of the multiplicity of contactor units C, by the pump means 46. The receiver tank S1 and supply tank S2 are vented tanks, each with a float valve means 44, as hereinabove described, to control operation of the regenerator R, through lines 44'. A cooling coil 70 operates in the desiccant supply tank S2, as hereinabove described.

From the foregoing, it will be understood how cogeneration can be economically associated with the preconditioning of outside air, in air conditioning which cooperatively combines two systems, a dehumidification support system that advantageously employs a regenerator chosen for its capability to operate continuously in a cost efficient manner, and contactors in a multiple system operating intermittently as circumstances may require. This cogeneration and central regeneration multi-contactor air preconditioning systems is also cooperatively combined with cooling coils and heating coils made economically and cost effective, being dependent upon cooperatively related waste heat exchange from a prime mover and the tempering of stored desiccant with chilled liquid drawn from a refrigeration means.

Having described only the typical preferred forms and applications of my invention, I do not wish to be limited or restricted ot the specific details herein set forth, but wish to reserve to myself any modificaitons or variations that may appear to those skilled in the art as set forth within the limits of the following claims.

I claim:

1. A central regeneration multi-contactor air conditioning, including:

a support system comprised of a desiccant regenerator means continuously removing desiccant liquid from a storage means and simultaneously returning regenerated desiccant liquid thereto for maintaining a useable desiccant vapor pressure condition controlled by concentration and temperature thereof in said storage means, and an air handling system comprised of a multiplicity of desiccant contactor means operated on demand and each drawing the desiccant liquid of useable concentration and temperature from the storage means for dehumidification of air passed therethrough, the storage means being comprised of a tank with a return of diluted desiccant liquid from the multiplicity of desiccant contactor means, a delivery of desiccant liquid from the tank to the regeneration means, a return of strengthened desiccant liquid from the regenerator means to the tank, and a supply of useable desiccant liquid from the tank to the contactor means.

2. The central regeneration multi-contactor air conditioning as set forth in claim 1, wherein the regenerator means includes spray means for discharging desiccant liquid into contact with air passed therethrough, heating means in the presence of the air contacted desiccant liquid, and a sump to collect said contacted desiccant liquid regenerated thereby to return to the storage means tank.

3. The central regeneration multi-contactor air conditioning as set forth in claim 1, wherein the contactor means includes spray means for discharging desiccant liquid into contact with air to be conditioned and passed therethrough, and chilling means in the presence of the air contacted desiccant liquid, and a sump to collect said contacted desiccant liquid diluted by dehumidification of the air contacted thereby.

4. The central regeneration multi-contactor air conditioning as set forth in claim 1, wherein the regenerator means includes spray means for discharging desiccant liquid into contact with air passed therethrough, heating means in the presence of the air contacted desiccant liquid, and a sump to collect said contacted desiccant liquid regenerated thereby for return to the storage means tank, and wherein the contactor means includes spray means for discharging desiccant liquid into contact with air to be conditioned and passed therethrough, and chilling means in the presence of the air contacted desiccant liquid, and a sump to collect said contacted desiccant liquid diluted by dehumidification of the air contacted thereby.

5. The central regeneration multi-contactor air conditioning as set forth in claim 1, wherein the support system includes a chiller and pump means circulating chilled fluid through cooling coils of the contactor means.

6. The central regeneration multi-contactor air conditioning as set forth in claim 1, wherein the air passed through the contactor means of the air handling system is from a chiller supplying sensible cooled air.

7. The central regeneration multi-contactor air conditioning as set forth in claim 1, wherein the support system includes a chiller and pump means circulating chilled fluid through cooling coils of the contactor means, and wherein the air passed through the contactor means of the air handling system is from a chiller supplying sensible cooled air.

8. The central regeneration multi-contactor air conditioning as set forth in claim 1, wherein the support system includes cogeneration means continuously producing electrical power and including a heat engine prime mover with its waste heat of combustion circulated through a heat exchanger and a pump means circulating heated fluid therefrom and through heating coils of the regenerator means.

9. The central regeneration multi-contactor air conditioning as set forth in claim 1, wherein the support system includes cogeneration means continuously producing electrical power and including a heat engine prime mover with its waste heat of combustion circulated through a water heater and a pump means circulating hot water therefrom and through heating coils for tempering the air conditioned by the contactor means.

10. The central regeneration multi-contactor air conditioning as set forth in claim 1, wherein the support system includes a chiller and pump means circulating chilled liquid through cooling coils of the contactor means and through a fire sprinkler means in a main from the chiller and pump means to said cooling cooling coils.

11. The central regeneration multi-contactor air conditioning as set forth in claim 1, wherein the support system includes a chiller and pump means circulating chilled liquid through cooling coils of the contactor means and through a fire sprinkler means in a main from said cooling coils to the chiller and pump means.

12. The central regeneration multi-contactor air conditioning as set forth in claim 1 wherein the support system includes a chiller and pump means circulating chilled fluid through cooling coils of the contactor means, and wherein said chiller and pump means circulates chilled fluid through a coil in said storage tank with temperature control means holding desiccant in the tank at useable temperature.

13. The central regeneration multi-contactor air conditioning as set forth in claim 1, wherein the storage means is comprised of a first receiver tank with a return of diluted desiccant liquid from the multiplicity of desiccant contactor means and with a delivery of dilute desiccant liquid to the regenerator means, and a second supply tank with a return of regenerated desiccant liquid from the regenerator means and with a supply of useful desiccant liquid therefrom to the contactor means.

14. The central regeneration multi-contactor air conditioning as set forth in claim 13, wherein the support system includes a chiller and pump means circulating chilled fluid through cooling coils of the contactor means, and wherein said chiller and pump means circulates chilled fluid through a coil in said second supply tank with temperature control means holding desiccant in the supply tank at useable temperature.

15. A central regeneration multi-contactor air conditioning, including;

a support system comprised of a desiccant regenerator means continuously removing desiccant liquid from a storage tank and simutaneously returing regenerated desiccant liquid thereto for maintaining a useable desiccant vapor pressure condition controlled by concentration and temperature thereof in said storage tank, and refrigeration means with pump means circulating chilled water through supply and return mains, and an air handling system comprised of a multiplicity of desiccant contactor means operated on demand and each drawing the desiccant liquid of useable concentration from the storage tank for dehumidification of air passed therethrough and from each contactor means through at least one air handling unit having a cooling coil in closed circuit with said supply and return mains for absorbing heat from the dehumidified air, there being a return of diluted desiccant liquid from the multiplicity of desiccant contactor means to the storage tank, a delivery of desiccant liquid from the storage tank to the regenerator means, a return of strengthened desiccant liquid from the regenerator means to the storage tank, and a supply of useable desiccant liquid from the storage tank to the contactor means.

16. The central regeneration multi-contactor air conditioing as set forth in claim 15, wherein the refrigeration means includes an evaporator circulating chilled water through the supply and return mains.

17. The central regeneration multi-contactor air conditioning as set forth in claim 16, wherein the refrigeration means includes an absorber circulating cooling tower water through second supply and return mains, and a cooling tower in closed circuit with said second supply and return mains.

18. The central regeneration multi-contactor air conditioning as set forth in claim 15, wherein the regenerator means includes spray means for discharging desiccant liquid into contact with air passed therethrough, heating means in the presence of the air contacted. desiccant liquid, and a sump to collect said contacted desiccant liquid regenerated thereby return to the storage tank, and wherein the support system includes cogeneration means continuously producing electrical power and including a heat engine prime mover with its waste heat of combustion circulated through a heat exchanger and a pump means circulating heated fluid therefrom and through the heating means of the regenerator means.

19. The central regeneration multi-contactor air conditioning as set forth in claim 15, wherein a cooling coil within storage tank is in circuit with chilled water through the supply and return mains.

20. The central regeneration multi-contactor air conditioning as set forth in claim 16, wherein a cooling coil within the storage tank is in circuit with chilled water through second supply and return mains.

21. A central regeneration multi-contactor air conditioning, including;

a support system comprised of a desiccant regenerator means continuously removing desiccant liquid from a storage tank and simultaneously returning regenerated desiccant liquid thereto for maintaining a useable desiccant vapor pressure condition controlled by concentration and temperature thereof in said storage tank, and heating means with pump means circulating heated water through supply and return mains, and an air handling system comprised of a multiplicity of desiccant contactor means operated on demand and each drawing the desiccant liquid of useable concentration from the storage tank for dehumidification of air passed therethrough and from each contactor means through at least one air handling unit having a heating coil in closed circuit with said supply and return mains for transfering heat into the dehumidified air, there being a return of diluted desiccant liquid from the multiplicity of desiccant contactor means to the storage tank, a delivery of desiccant liquid from the storage tank to the regenerator means, a return of strengthened desiccant liquid from the regenerator means to the storage tank, and a supply of useable desiccant liquid from the storage tank to the contactor means.

22. The central regeneration multi-contactor air conditioning as set forth in claim 2, wherein the support system includes cogeneration means continuously producing electrical power and including a heat engine prime mover with its waste heat of combustion circulated through a water heater and a pump means circulating heated water therefrom and throughthe supply and return mains.

* * * * *

UNITED STATES PATENT AND TRADEMARK OFFICE

CERTIFICATE OF CORRECTION

PATENT NO. : 4,691,530

DATED : September 8, 1987

INVENTOR(S) : MILTON MECKLER

It is certified that error appears in the above—identified patent and that said Letters Patent is hereby corrected as shown below:

IN THE DRAWINGS:
Fig. 1, remove indicia "28-29" and line with arrow extending from regenerator R to contactors C. Fig. 2, remove the line extending from outlet of pump 41 to bottom of chiller 40, and remove the line extending from numeral 8 to return main 53; and connect the line extending down from numeral 8 to bottom right arrow into the chiller 40. Fig. 2, reverse the flow direction arrows in both lines 55 and 56. Fig. 5 change "31" at left side of regenerator R to --32--.

IN THE SPECIFICATION:
Col. 2 line 48 change "congeneration" to --cogeneration--. Col. 3 line 2 change "continusouly" to --continuously--; line 23 change "revailing" to --prevailing--; line 24 change "coaincident" to --coincident--. Col. 5 line 2 change "C" to --A--; line 33 before "mixing" insert --of--; line 40 before "absorption" insert --of--; line 51 change "disharges" to --discharges--. Col. 6 line 17 delete "controlled by a float valve means 32"; line 21 before "The" insert --Pump 36 is controlled by a float valve means 32.--; line 68 change "deignated" to --designated--. Col. 7 line 12 change "absorbergenerator" to --absorber-generator--; line 42 change second occurance of "28" to --29--; line 47 change "throught" to --through--. Col. 8 line 3 change "desciccant" to --desiccant--; line 37 change "ot" to --to--.

IN THE CLAIMS:
Col. 9 line 64 delete second occurance of "cooling".

UNITED STATES PATENT AND TRADEMARK OFFICE

CERTIFICATE OF CORRECTION

PATENT NO. : 4,691,530

DATED : September 8, 1987

INVENTOR(S) : MILTON MECKLER

It is certified that error appears in the above-identified patent and that said Letters Patent is hereby corrected as shown below:

Col. 10, line 60, "ditioing" should read -- ditioning --.

Signed and Sealed this

Sixteenth Day of February, 1988

*Attest:*

DONALD J. QUIGG

*Attesting Officer*

*Commissioner of Patents and Trademarks*